US005607110A

United States Patent [19]

Schmitt

[11] Patent Number: 5,607,110

[45] Date of Patent: Mar. 4, 1997

[54] DEVICE FOR DISCHARGING BLOWING AIR

[75] Inventor: Manfred Schmitt, Eschelbronn, Germany

[73] Assignee: Heidelberger Druckmaschinen AG, Heidelberg, Germany

[21] Appl. No.: 355,962

[22] Filed: Dec. 14, 1994

[51] Int. Cl.[6] ..... B05B 1/00

[52] U.S. Cl. ..... 239/598; 239/394

[58] Field of Search ..... 239/561, 568, 239/581.1, 597, 598, DIG. 22, 394, 392–390

[56] References Cited

U.S. PATENT DOCUMENTS

| | | | |
|---|---|---|---|
| 2,695,002 | 11/1954 | Miller | 239/597 X |
| 3,051,183 | 8/1962 | Jacobs | 239/568 X |

FOREIGN PATENT DOCUMENTS

| | | |
|---|---|---|
| 502177 | 6/1930 | Germany . |
| 617838 | 4/1934 | Germany . |
| 4235331 | 4/1994 | Germany . |

*Primary Examiner*—Lesley D. Morris

*Attorney, Agent, or Firm*—Herbert L. Lerner; Laurence A. Greenberg

[57] ABSTRACT

An adjustable discharge nozzle for blowing air is constructed in a structurally simple manner. A second pipe section is fit over a first pipe section substantially without play and it is fixed longitudinally but rotatable about the longitudinal axis. A relative rotation of the two pipe sections moves a blowing air discharge opening along a longitudinal direction defined by the pipes. The blowing air outlet is defined as an overlap between a longitudinal slit formed in the first pipe section and an oblique slit formed in the second pipe section. The oblique slit is inclined relative to the longitudinal slit.

4 Claims, 1 Drawing Sheet

Fig. 3a
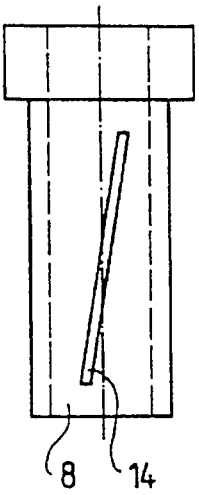
Fig. 3b
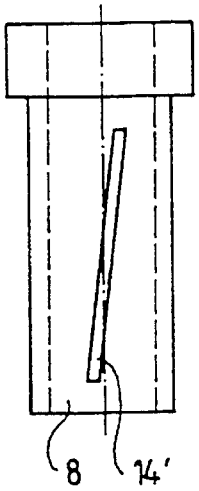
Fig. 3c
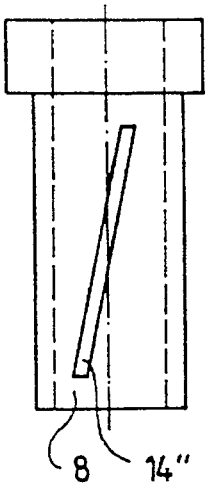
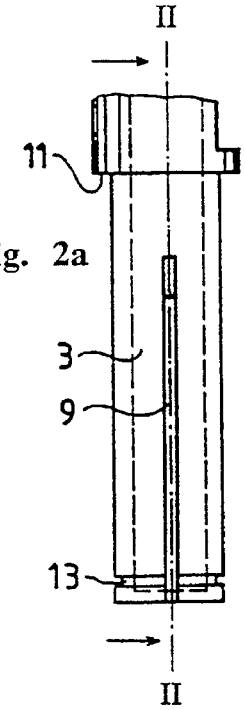
Fig. 2a
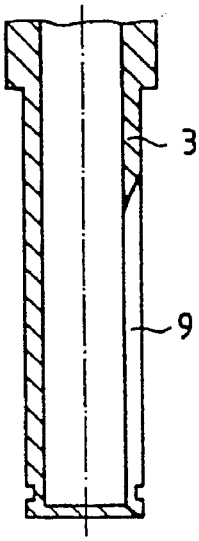
Fig. 2b
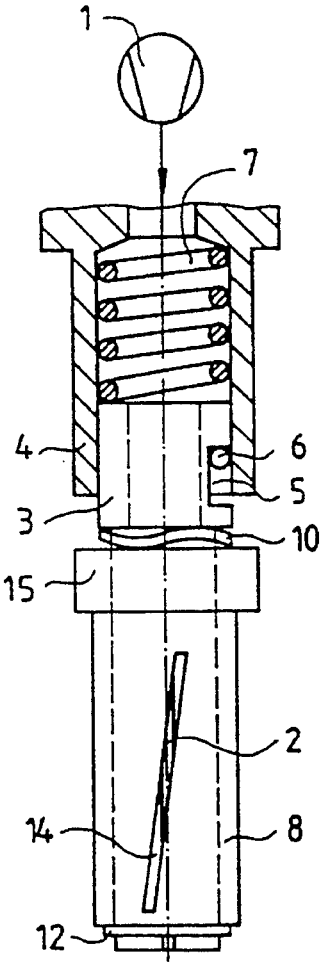
Fig. 1

DEVICE FOR DISCHARGING BLOWING AIR

BACKGROUND OF THE INVENTION

Field of the Invention

The invention relates to a device for discharging blowing air with two pipe sections of which one is adjustably inserted into the other; the pipe sections communicate with a blowing air source on the one hand and with a blowing air discharge nozzle on the other hand; the blowing air discharge outlet is moveable in the longitudinal direction of the pipe sections by means of a relative adjustment thereof.

Feeders of sheet-fed printing machines of Heidelberger Druckmaschinen AG, for instance, are provided with devices of that kind. They serve to pre-loosen an uppermost layer of sheets to be printed and which are stacked in the feeder. A first pipe section carrying the blowing air outlet is thereby adjustable relative to a second pipe section in a telescoping fashion and the longitudinal direction of the pipe section is perpendicularly oriented, so that, in the case the device is mounted in a stationary position, the location of the blowing air outlet may be adjusted to match the level of the uppermost layer of the sheets within certain boundaries. For the purpose of allowing the aforementioned telescoping adjustment, an end piece of the first pipe section is fit into an end piece of the second pipe section and it is provided with an entrainer pin inserted transversely to its longitudinal direction whose respective ends are guided in a respective longitudinal slit of the second pipe section. The ends of the pin radially project beyond the second pipe section. The second pipe section is provided with an outer thread for a set nut cooperating therewith, on which the ends of the entrainer pin rest under the action of a spring.

The blowing air discharge outlet of the known device is defined by an array of relatively fine air discharge bores. A "soft" blowing air jet can be attained with great suitability for the aforementioned utilization for loosening an uppermost layer of sheets which are stacked in a feeder. This, however, requires a sensitive fine adjustment of the height level of the blowing air discharge outlet formed by the individual air discharge bores with respect to the height of the upper edge of the sheet stack. This fine adjustment is effected by a corresponding rotation of the above-mentioned set nut and, while it is easy to manipulate, it still entails a certain structural expense for the mechanics of adjusting the first pipe section which communicates with the blowing air discharge outlet.

SUMMARY OF THE INVENTION

It is accordingly an object of the invention to provide a device for discharging blowing air, which overcomes the hereinafore-mentioned disadvantages of the heretofore-known devices of this general type and which is structurally simple and operator-friendly. The device should preferably be suitable as a loosening blower in the feeder of a sheet-fed printing machine.

With the foregoing and other objects in view there is provided, in accordance with the invention, a device for discharging blowing air, comprising:

a first pipe section defining a longitudinal axis, the first pipe section having an open end communicating with a blowing air source and a closed end opposite the open end, the first pipe section having a longitudinal slit formed therein with a given length for allowing a passage of blowing air therethrough;

a second pipe section adjustably fit over the first pipe section and encasing the first pipe section substantially without play, the second pipe section extending over a substantial portion of the length of the longitudinal slit, the second pipe section having at least one oblique slit formed therein inclined relative to the longitudinal slit formed in the first pipe section, the longitudinal slit and the oblique slit together defining an air discharge opening at a location where they overlap one another; and means for arresting the second pipe section relative to the first pipe section in a position in which it is substantially stationary in a direction parallel to the longitudinal axis, and allowing a rotation thereof relative to the first pipe section about the longitudinal axis for movably adjusting the air discharge opening along a longitudinal direction of the first and second pipe section.

In other words, if it is desired to move the blowing air discharge outlet in the longitudinal direction of the pipe sections, it is only necessary, in accordance with the invention, to rotate the second pipe section about its longitudinal axis relative to the first pipe section. Such a structural simplification relative to the prior art thus already results in the omission of the set nut provided in the prior art device and the cooperating thread necessary for shifting the blowing air discharge outlet.

Due to the fact that the second pipe section encloses the first pipe section only in a position which is fixed in its longitudinal direction, the structural measures and the means for adjustable insertion of the pipe section are simplified.

In accordance with another feature of the invention, the at least one oblique slit is a plurality of slits including a first oblique slit formed in the second pipe section, a second oblique slit following the first oblique slit in a circumferential direction defined about the second pipe section, and a third oblique slit following the second oblique slit in the circumferential direction, each of the first, second and third oblique slits having a form being different from a respectively preceding one.

This is a very advantageous further development of the invention. It is thus possible to vary parameters of the discharging blowing air without varying the pressure of the blowing air fed into the device and without exchanging a component of the device. This embodiment is distinguished in that a first oblique slit of the second pipe section is followed in its circumferential direction with further oblique slits, whereby each further oblique slit is formed differently as compared to a respectively preceding one.

In accordance with an added feature of the invention, the device includes spring means supporting the first pipe section at the open end for supporting a component unit formed of the first and second pipe sections in a springy manner along the longitudinal direction thereof.

With a view to the preferred use of the device as a loosening blower in the feeder of a sheet-fed printing machine, these features prove quite advantageous. For instance, the loosening blower can resiliently withdraw if it comes into contact with a pallet which carries the stacked sheets and which is successively lifted by a lifting device.

In accordance with a concomitant feature of the invention, the longitudinal slit formed in the first pipe section extends to the closed end thereof facing away from the blowing air source, and wherein the longitudinal slit is exposed at the closed end.

A further advantageous embodiment of the invention assures a loosening of an uppermost layer of a stack formed of sheets in a feeder of a sheet-fed printing machine, even in the case when the stack has been reduced to a small number of sheets. This further embodiment is distinguished in that the longitudinal slit in the first pipe section reaches to the front face of the end which faces away from the blowing air source and which is covered up in the vicinity of that end.

Other features which are considered as characteristic for the invention are set forth in the appended claims.

Although the invention is illustrated and described herein as embodied in a device for discharging blowing air, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 1 is a partly sectional, partly diagrammatic, elevational view of a device according to the invention in an assembled condition;

FIG. 2*a* is a partial, elevational view of a first pipe section of the device;

FIG. 2*b* is a partial sectional view taken along the line II—II of FIG. 2*a* and viewed in the direction of the arrows;

FIGS. 3*a*–3*c* are three elevational views of a second pipe section, each view rotated (by 90°) relative to a respectively adjacent view.

DESCRIPTION OF THE PREFERRED EMBODIMENTS

Referring now to the figures of the drawing in detail and first, particularly, to FIG. 1 thereof, there is seen a diagrammatic illustration of an air source 1 (a separate pump or a connection to the air supply of a printing machine, for instance), which stands in communication with an air discharge outlet 2.

A first pipe section 3 is mounted in a short feed pipe 4, which is supplied with blowing air from the air source 1. Particularly, an end of the first pipe section 3 which is oriented towards the blowing air source 1 is fit into the short feed pipe 4 and non-rotatably fixed by means of a locking-pin 6. The locking-pin 6 pierces the feed pipe 4 transversely (defining a secant line of the round cross-section) and it rests on a flat surface 5 formed on the first pipe section 3 (also defined along secant thereof). A helical compression spring 7 is inserted in the short feed pipe 4. The spring 7 rests inside the feed pipe 4 on the one hand and on a face of the first pipe section 3 fit into the pipe 4 on the other hand. When the component unit is assembled as illustrated in FIG. 1, the spring results in a springy support for the unit—to the extent allowed by the width of the flattened surface 5 in the longitudinal direction of the first pipe section 3.

The component unit comprises the first pipe section 3 provided with a longitudinal slit 9 formed therein and closed off at an end away from the blowing air source 1 (see also FIG. 2), the second pipe section 8, which surrounds the first pipe section 3 virtually without play and which has an oblique slit 14 which is inclined relative to the slit 9, as well as arresting means with which the second pipe section 8 is mounted on the first pipe section 3 in a position which is fixed in the longitudinal direction of the first pipe section 3.

The second pipe section 8 is thereby inserted with a first front surface thereof onto the first pipe section 3 from the closed end thereof, it is pressed against a shoulder 11 formed at the first pipe section (see particularly FIG. 2) with the intermediary of a spring disk 10, and it is fixed by means of a retaining ring 12, which rests against a second front surface of the second pipe section 8 opposite the aforementioned first front surface and engages into a circumferential groove 13 formed in the first pipe section 3.

The longitudinal slit 9 formed in the first pipe section 3 extends all the way to the front surface of the end of the pipe section 3 which faces away from the blowing air source 1 (the bottom end in each of the views). The use of the safety means provided herein, i.e. the retaining ring 12 in particular, requires a certain spacing of the circumferential groove 13 for receiving the ring from the closed end of the first pipe section 3. This, together with the above-mentioned extent of the longitudinal slit 9, leads to the situation that the same is in each case not covered up in the vicinity of that end of the first pipe section 3 which faces away from the blowing air source 1.

It is also provided, in another embodiment of the invention, and it is sufficient for certain applications, for the longitudinal slit 9 to have an end away from the blowing air source 1 inside the longitudinal expanse of the second pipe section 8. Such an application would be, for instance, the use of the device as a loosening jet in a delivery of a sheet-fed printing machine for use in non-stop operation, whereby a certain minimum height of the sheet stack can always be maintained.

The end of the longitudinal slit 9 facing towards the blowing air source 1 is suitably located inside the longitudinal extent of the second pipe section 8, as realized in the illustrated exemplary embodiment and as can be seen in comparing FIGS. 1 and 2. While such a formation is useful, it is not necessary. While illustrated in the preferred embodiment, it is also not necessary for the oblique slit 14 to have ends within the longitudinal extent of the second pipe section 8.

The blowing air discharge outlet 2 is formed as the summed section of the openings formed by the longitudinal slit 9 and the slit 14. In other words, the discharge opening 2 is defined by that area of the two slits 9 and 14 which is the overlap of the two. The position of this blowing air outlet 2 is variable by turning the second pipe section 8 about its symmetry axis along the longitudinal axis of the pipe section 8.

In the illustrated embodiment, the second pipe section 8 is provided with a collar 15 at its end facing towards the blowing air source 1 which, if suitable, may be provided at its periphery with flattened portions or with a rim or the like, so as to provide a suitable contact surface for rotating the pipe section 8 by hand.

The disk spring 10 clamped between the collar 15 and the shoulder 11 of the first pipe section 3 serves to prevent an unwanted rotation of the second pipe section 8.

The longitudinal slit 9 and the slit 14 are suitably formed with a constant slit width, so that, when the second pipe section 8 is rotated, only the position of the otherwise unchanged blowing air jet is varied.

FIG. 3 illustrates an embodiment of a second pipe section 8 in sequential views, which are rotated relative to one another by 90° about its symmetry axis, in which a second oblique slit 14' follows a first inclined slit 14 in the circumferential direction of the pipe section 8, and then a third inclined slit 14". The slits 14' and 14" are hereby differently inclined as compared to the slit 14 and/or they have a different slit width. This makes it possible in one and the same device to also vary parameters of the blowing air jet besides moving the same by simply choosing a corresponding combination of the longitudinal slit 9 with one of the oblique slits 14, 14', 14".

Such an embodiment of the second pipe section 8, in which a suitable portion of its periphery is void of any oblique slit, and in which the length of the longitudinal slit 9 is correspondingly chosen, makes it possible to prevent any blowing air from escaping from the device. In other words, the device may be closed entirely by simply turning the pipe section 8. No additional measures are necessary in that respect, such as for instance a closure valve of a supply line leading to the device.

I claim:

1. A device for discharging blowing air, comprising:

a first pipe section defining a longitudinal axis, said first pipe section having an open end communicating with a blowing air source and a closed end opposite said open end, said first pipe section being non-rotatably fixed and having a longitudinal slit formed therein with a given length for allowing a passage of blowing air therethrough;

a second pipe section adjustably fit over said first pipe section and encasing said first pipe section substantially without play, said second pipe section extending over a substantial portion of the length of said longitudinal slit, said second pipe section having at least one oblique slit formed therein inclined relative to said longitudinal slit formed in said first pipe section, said longitudinal slit and said at least one oblique slit together defining an air discharge opening at a location where they overlap one another;

means for arresting said second pipe section relative to said first pipe section in a position in which it is substantially stationary in a direction parallel to said longitudinal axis, and allowing a rotation thereof relative to said first pipe section about said longitudinal axis for movably adjusting the air discharge opening along a longitudinal direction of said first and second pipe section; and means engaging said first and second pipe sections for preventing an unwanted rotation of said second pipe section.

2. The device according to claim 1, wherein said at least one oblique slit is a plurality of slits including a first oblique slit formed in said second pipe section, a second oblique slit following said first oblique slit in a circumferential direction defined about said second pipe section, and a third oblique slit following said second oblique slit in the circumferential direction, each of said first, second and third oblique slits having a form being different from a respectively preceding one.

3. A device for discharging blowing air, comprising:

a first pipe section defining a longitudinal axis, said first pipe section having an open end communicating with a blowing air source and a closed end opposite said open end, said first pipe section having a longitudinal slit formed therein with a given length for allowing a passage of blowing air therethrough;

a second pipe section adjustably fit over said first pipe section and encasing said first pipe section substantially without play, said second pipe section extending over a substantial portion of the length of said longitudinal slit, said second pipe section having at least one oblique slit formed therein inclined relative to said longitudinal slit formed in said first pipe section, said longitudinal slit and said at least one oblique slit together defining an air discharge opening at a location where they overlap one another;

means for arresting said second pipe section relative to said first pipe section in a position in which it is substantially stationary in a direction parallel to said longitudinal axis, and allowing a rotation thereof relative to said first pipe section about said longitudinal axis for movably adjusting the air discharge opening along a longitudinal direction of said first and second pipe section; and spring means supporting said first pipe section at said open end for supporting a component unit formed of said first and second pipe sections in a springy manner along the longitudinal direction thereof.

4. A device for discharging blowing air, comprising:

a first pipe section defining a longitudinal axis, said first pipe section having an open end communicating with a blowing air source and a closed end opposite said open end, said first pipe section having a longitudinal slit formed therein with a given length for allowing a passage of blowing air therethrough;

a second pipe section adjustably fit over said first pipe section and encasing said first pipe section substantially without play, said second pipe section extending over a substantial portion of the length of said longitudinal slit, said second pipe section having at least one oblique slit formed therein inclined relative to said longitudinal slit formed in said first pipe section, said longitudinal slit and said at least one oblique slit together defining an air discharge opening at a location where they overlap one another;

means for arresting said second pipe section relative to said first pipe section in a position in which it is substantially stationary in a direction parallel to said longitudinal axis, and allowing a rotation thereof relative to said first pipe section about said longitudinal axis for movably adjusting the air discharge opening along a longitudinal direction of said first and second pipe section, wherein said longitudinal slit formed in said first pipe section extends to said closed end thereof facing away from the blowing air source, and wherein said longitudinal slit is exposed at said closed end.

* * * * *